United States Patent [19]

Morgan et al.

[11] 4,429,653

[45] Feb. 7, 1984

[54] MEANS EMPLOYING HYDRO-JETS FOR FACILITATING THE CLEARING OF DISAGGREGATED ICE CHUNKS FROM THE CUTTING REGION

[75] Inventors: George W. Morgan, San Jose, Calif.; Vernon F. Wetzel, Calgary, Canada

[73] Assignee: Suncor, Inc., Toronto, Canada

[21] Appl. No.: 344,447

[22] Filed: Feb. 1, 1982

Related U.S. Application Data

[63] Continuation of Ser. No. 140,041, Apr. 14, 1980, abandoned.

[51] Int. Cl.[3] ..... B63B 35/12

[52] U.S. Cl. ..... 114/42; 405/61; 405/217

[58] Field of Search ..... 114/40–42, 114/312, 313, 339; 261/93; 405/61, 211, 217

[56] References Cited

U.S. PATENT DOCUMENTS

| | | | |
|---|---|---|---|
| 3,530,814 | 9/1970 | Rastorguev et al. | 114/40 |
| 3,572,273 | 3/1971 | Wood | 114/40 |
| 3,669,052 | 6/1972 | Schritzinger | 114/42 X |
| 3,759,046 | 9/1973 | Anders | 114/41 X |
| 3,957,442 | 5/1976 | Yamamoto et al. | 261/77 X |
| 3,965,835 | 6/1976 | Bennett | 114/42 |
| 3,969,446 | 7/1976 | Franklin, Jr. | 261/93 X |
| 4,005,666 | 2/1977 | Schirtzinger | 114/42 |
| 4,022,142 | 5/1977 | Stegall | 114/42 |
| 4,029,724 | 6/1977 | Muller et al. | 261/93 X |
| 4,030,305 | 6/1977 | Wilson | 114/244 X |
| 4,102,288 | 7/1978 | Barry et al. | 114/41 |
| 4,137,285 | 1/1979 | Nojiri | 261/93 |
| 4,156,712 | 5/1979 | Kanai | 261/93 X |
| 4,159,307 | 6/1979 | Shigeyasu | 261/93 |
| 4,207,275 | 6/1980 | Stanton, Jr. et al. | 261/93 |

FOREIGN PATENT DOCUMENTS

| | | | |
|---|---|---|---|
| 2823074 | 11/1979 | Fed. Rep. of Germany | 114/40 |
| 512105 | 6/1976 | U.S.S.R. | 114/40 |

*Primary Examiner*—Sherman Basinger
*Attorney, Agent, or Firm*—Paul Lipsitz

[57] ABSTRACT

In order to assist ice chunks along preferred discharge paths in a large scale ice disaggregation system employing counter-rotating twin cutters, water is pumped tangentially across the trailing edges of the counter-rotating cutters against the direction of rotation to overcome the centrifugal action which tends to cause ice jamming. Secondary hydro-jets may be employed to further urge the ice chunks away from the vessel into the open region previously cut.

3 Claims, 4 Drawing Figures

MEANS EMPLOYING HYDRO-JETS FOR FACILITATING THE CLEARING OF DISAGGREGATED ICE CHUNKS FROM THE CUTTING REGION

This is a continuation of application Ser. No. 140,041, filed Apr. 14, 1980 now abandoned.

CROSS-REFERENCES TO RELATED APPLICATIONS

This application contains subject matter related to U.S. application Ser. No. 140,042 filed on even date herewith and entitled "Means for Controlling the Ascent Rate of Disaggregated Ice Chunks" By Vernon F. Wetzel and George W. Morgan, now abandoned.

BACKGROUND OF THE INVENTION

This invention relates to the ice disaggregation arts and, more particularly, to novel means for clearing disaggregated ice from the cutter region when the expansion factor of such disaggregated ice otherwise limits the cutting rate.

In the petroleum exploration, drilling, and production industry, it is often necessary to move and station men and equipment in relatively hostile environmental regions. In recent years, the emphasis on offshore oil production in the far north has necessitated the development of new techniques for encountering formations of encroaching ice floes and the movements thereof which threaten the stability and/or position of equipment situated therearound.

In the Arctic, offshore Labrador, and the like, large regions of the ocean are often covered by thick layers of ice. Currently, there is considerable activity in these and other frozen areas directed toward the discovery and development of sources of petroleum and other natural resources. The search for and production of these resources require operational platforms for housing equipment and personnel. These platforms are typically passively transported to their operational sites and maintained in a relatively fixed position with respect to the underwater floor by anchoring thereto and/or by the utilization of dynamic positioning techniques. It may be noted, however, that some such platforms are self-propelled. In the normal course of operation, drill-strings, pipes, and the like are extended from the platform into the earth's sub-surface for accessing and recovering natural resources such as petroleum. It is thus important to maintain the platform within a predetermined envelope in order to prevent breaking or, whenever possible, the necessity for withdrawing the extended apparatus from the ocean floor.

Platforms located in both shallow and deep waters are exposed to ice floes which sometimes float freely on the water and/or unitary ice formations which flow insidiously. The ice may be so massive that a platform is susceptible to damage or destruction as a result of forces imparted thereagainst by the moving ice. The Arctic Ocean, for example, is characterized by air temperatures ranging from −70° F. to 70° F., ice sheets and thicknesses between 6 and 10 feet, and pressure ridges of 10 to 100 feet. In such conditions, ice typically exhibits a compressive strength of 1,000 to 3,000 psi and tensile strength of 300 to 1,000 psi. The problems of providing the requisite magnitude of force and power necessary for engagement with and disaggregation of such an environmental threat may be seen to be formidible.

Drilling and operations platforms for use in ice covered areas may take several different forms. One such platform includes a monopod, semi-submersible design utilizing a single rotating cutter completely encircling the intermediate hull section proximate the waterline for ice floe engagement and disaggregation. The cutter is disposed between upper superstructure comprising an operations platform and a submerged hull providing flotation and storage. In this manner, only a relatively narrow profile emerges through encroaching ice layers while platform surface area is maximized and buoyancy size parameters are met, respectively, above and below the ice.

A similar operations platform, which is disclosed in detail in U.S. Pat. No. 4,104,288 entitled "Operations Vessel for Ice Covered Seas", comprises a monopod, semi-submersible drilling vessel constructed with an ice-breaking wedge and ice disaggregation apparatus, the wedge and ice disaggregation apparatus comprising an intermediate hull section. The nautical wedge facilitates transit operation in both open and ice laden waters and also achieves ice-breaking within its capability while in the operating mode. The ice disaggregation portion of the intermediate hull section includes a plurality of drums rotatably mounted in generally upstanding relationship relative to the submersible hull. The drums include an outer surface adapted for breaking, cutting and/or chipping ice engaged thereby. Preferably, a pair of drums is mounted for counter-rotation such that reaction torque is cancelled and other benefits are obtained.

In the operation of such large semi-submersible operations vessels employing correspondingly large ice engaging drum structures, clearing of the broken ice chunks creates an unprecedented problem. As the ice is disaggregated from the main ice sheet, it passes into the annulus area where, due to the disaggregation process, it expands in volume. It is believed that this increased volume is approximately one-third greater than the original volume of the uncut ice.

Within the annulus area (i.e., proximate the counter-rotating drums) the disaggregated ice particles are moved through the discharge side areas at a speed approximately that of the rotational speed of the cutters. However, once the ice chunks pass through the restricted discharge side areas, they enter the full width cleared by the cutters. In this region, there is a rapid drop in velocity resulting in the ice packing behind the particles previously cleared. When the ice is relatively thin, discharged particles can move beneath the ice sheet provided the volume cut remains low. As the ice becomes thicker and/or with an increase in the speed of the cutters and the vessel, the disaggregated ice can rapidly become packed preventing any further flow of the discharged material. The quantity discharged can be enormous. For a cutting width of fifty-three feet, fifty-five foot thick ice, and a formed cutting velocity of 1.83 feet/second, approximately 5,300 cubic feet of ice is disaggregated per second. Thus, it will be apparent that, in order for the vessel to maintain position or traverse the ice when disaggregating large volumes of ice, the discharged ice particles in the ice in the discharged area must be kept moving and directed in such a way as to aid in clearance. The means for controlling the disaggregated ice chunks' discharge paths contemplated by the present invention achieves favorable ice clearing characteristics to thereby significantly increase the maximum cutting rate beyond that which can be achieved without such discharge path control.

SUMMARY OF THE INVENTION

It is therefore a broad object of this invention to provide, in a semi-submersible operations vessel including ice disaggregating apparatus, improved means for clearing disaggregated ice chunks from the region in which they are broken from an ice mass.

It is a more specific object of this invention to facilitate such clearing by forcing the disaggregated ice chunks to follow a preferential discharge path.

Briefly, these and other objects of the invention are achieved by providing jets of pressurized seawater to intercept disaggregated ice chunks as they tend to follow the periphery of the rotating ice-breaking drums and to guide the chunks to a region where additional pressurized seawater jets urge the ice chunks away from the operations vessel.

DETAILED DESCRIPTION OF THE INVENTION

Figure 1:
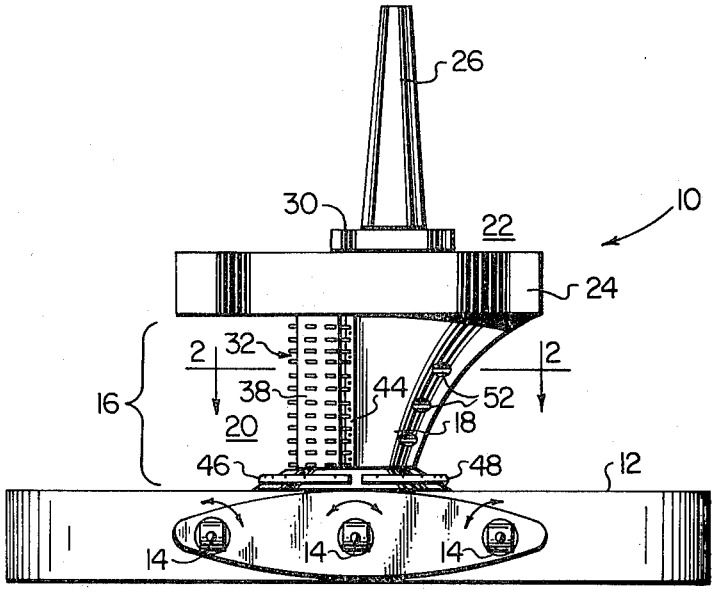
FIG. 1 is a side elevational view of an operations vessel for ice covered seas which incorporates the present invention.

Referring first to FIG. 1, there is shown a side elevational view of an operations vessel for ice covered seas which incorporates the present invention. The vessel shown is an exemplary environment in which the invention finds particular use and is a semi-submersible, monopod platform 10 for petroleum drilling, production, processing, and/or storage or the like. The operations vessel has a flotation hull section 12 adapted for submerged support and sustenance of the remaining vessel and also providing storage therefor. A plurality of propulsion units in the form of thrusters 14 are disposed around the flotation hull 12 for providing a transit mode of operation, dynamic positioning while in a stationary mode, and the capacity to engage ice floes in the positioning and operation thereof.

The operations vessel 10 is constructed with an intermediate hull section 16 which extends upwardly from the flotation hull 12 and includes a bow portion 18 and stern section 20 adapted for ice disaggregation. Atop the intermediate hull 16, a deck structure 22 is provided for housing above-water operations. Deck 22 includes a shrouded superstructure 24 from which a derrick 26 (or other producing, processing, or storage equipment) upstands. Derrick 26 includes a shroud for safety and environmental protection and for decreasing wind drag forces. An operations area 30 therebelow is similarly provided in a shrouded configuration beneath and adjacent the derrick 26 for protecting platform personnel during platform operations. In the shrouded configuration shown herein, the topside profile of the operations vessel 10 is substantially comprised of circular shapes which eliminates wind direction sensitivity and the disadvantages thereof.

Figure 2:
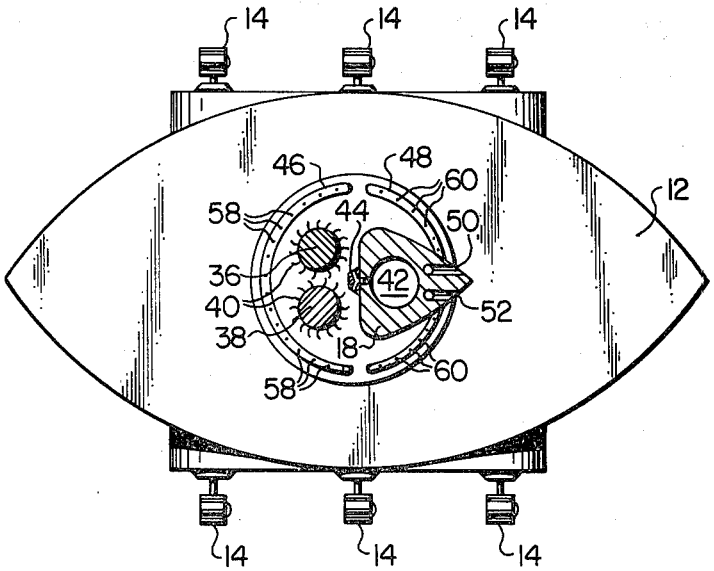
FIG. 2 is a top plan, cross-sectional view of the vessel of FIG. 1 taken along lines 2—2 thereof.

Referring now to FIG. 2, it may be seen that the flotation hull 12 of the operations vessel 10 is constructed for bi-directional movement in and through ice covered seas. The flotation hull 12 is therefore preferably comprised of an elliptical configuration which facilitates underwater movement and position stabilization. FIGS. 1 and 2 also illustrate the provision of structural bow section 18 constructed in the shape of a nautical wedge. The term "nautical wedge" is utilized herein to include the generally tapered wedge configuration of the type commonly incorporated into the bow of relatively large ships and particularly adapted for marine applications wherein ice is encountered. The bow 18 facilitates not only improved movement through water and more effective ice breaking ice operations in both transit and positional modes, but also serves as a streamlined baffle for the stern section 20 whereat active ice disaggregation apparatus is employed.

It may be seen that the particular ice disaggregation apparatus 32 incorporated into the stern section 20 of the operations vessel 10 includes a pair of rotating drums 36 and 38, having spikes 40 outwardly extending therefrom. The spikes 40 comprise ice disaggregation teeth particularly adapted for cutting, chipping, and/or breaking the ice. The spikes 40 may also be arranged in graduated lengths and/or in spaced arrays longitudinally along the drum for maximizing the ice disaggregation efficiency thereof. One particularly efficient configuration for the spikes 40 is discussed in detail in co-pending U.S. application Ser. No. 139,960, entitled "Cutter Configuration for Efficient Ice Disaggregation and Clearing" and filed of even date herewith, now U.S. Pat. No. 4,244,185. Other efficient configurations for the ice engaging means mounted on the drum peripheries are disclosed in co-pending U.S. applications: Ser. No. 940,245, filed Sept. 7, 1978, and entitled "Means for Increasing the Efficiency of an Ice Disaggregation System"; Ser. No. 940,246, filed Sept. 7, 1978 (now U.S. Pat. No. 4,348,059), and entitled "Multiple Tine Ice Disaggregation System"; and Ser. No. 940,247, filed Sept. 7, 1978 (now U.S. Pat. No. 4,365,517), and entitled "Ice Disaggregation System".

Still referring to FIG. 2, it may be seen that the drums 36 and 38 are adapted for counter-rotation. Drum 36 is therein shown to rotate clockwise as illustrated, while drum 38 rotates counterclockwise. With this construction, reaction torque applied to the vessel, as by single-drum ice disaggregation means, is eliminated. The cancellation of reaction torque negates the requisite actuation of thrusters 14 to counter the effect of drum rotation. In the illustrated operations vessel, the thrusters 14 can thus be fully utilized to counter the momentum of an engaged ice floe during disaggregation when the platform 10 is preferably fixedly positioned over the ocean floor for operation activity, or during transit. The moon pool 42, shown extending through the bow section 18, is provided for such operations wherein drilling, servicing, or producing pipe is lowered and operated therethrough. The moon pool 42 is preferably shielded from the drums 36 and 38 and the engaged ice floe itself, as shown, to prevent broken sections of ice from hampering drilling, servicing, or producing operations.

The particular advantages of this operations vessel configuration are set out in U.S. Pat. No. 4,102,288, issued July 25, 1978. Briefly, various types of ice encountered may be engaged by either the ice breaking bow 18 or the ice disaggregation apparatus 32 during either transit or stationary operational modes.

Still referring to FIGS. 1 and 2, it will be observed that two pressurized air conduits 46, 48 are disposed generally semicircularly proximate the base of the intermediate hull portion 16 of the operations vessel 10. The conduit 46 is disposed generally outboard the ice disaggregation apparatus 32, and the conduit 48 is similarly disposed generally outboard the base of the icebreaking bow 18. The pressurized air conduits 46, 48 have a series of air releasing apertures 58, 60 distributed along their respective lengths. As will be more fully described below, compressed air is controllably issued through the release apertures 58, 60 to adjust the buoyancy of the water in the region of disaggregated ice in order to effect control of the rate of ascent of the broken ice chunks.

As shown in FIG. 1, but somewhat more clearly in FIG. 2, a water jet fixture 44 extends vertically for much of the height of the icebreaking bow 18 in the aft region proximate and generally equidistant from the axes of the drums 36, 38. The column 44 is provided with a plurality of vertically distributed nozzle openings 54, 56 which are directed, respectively, to the regions between the rear portion of the icebreaking bow 18 and the drums 36, 38. Additionally, one or more individually controllable pairs of hydrojet conduits 50, 52 open intermediate the height of the icebreaking bow 18 on either side of the leading edge thereof.

Figure 3:
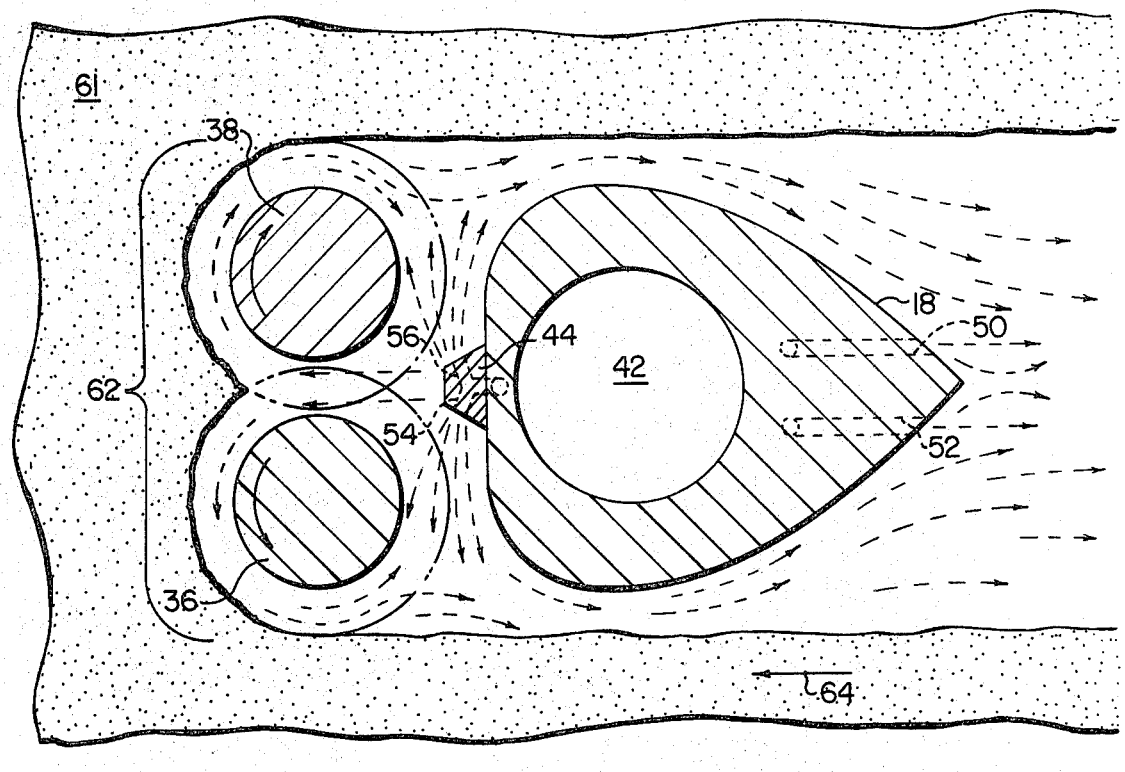
FIG. 3 is a plan view showing the flow of ice chunks resulting from operation of the hydrojets.

The operation and effect of the hydrojets may best be understood by reference to FIG. 3 in which the paths of disaggregated ice chunks are generally represented by a series of dashed arrows. As ice in the sheet 61 is broken in the region 62 as the operations vessel moves in the direction of the arrow 64 with respect to the ice 61, the tendency is to bring the ice chunks around into the region between the drums 36, 38 and the "trailing" edge of the ice breaking bow 18. Pack up can occur very rapidly such that no further ice disaggregation can take place. However, pressurized seawater (provided by conventional pump means, not shown) issued through the nozzles 54 and 56 of the vertical column 44 counteract this tendency and force the disaggregated ice chunks to flow generally outwardly on each side of the nautical wedge 18 and discharge toward the rear where further hydrojets from the nozzles 50, 52 urge the ice chunks to move rearwardly away from the ice breaking bow. In this manner, pack up due to the centrifugal force of the ice chunks in the critical region between the drums 36, 38 and the nautical wedge is avoided.

Figure 4:
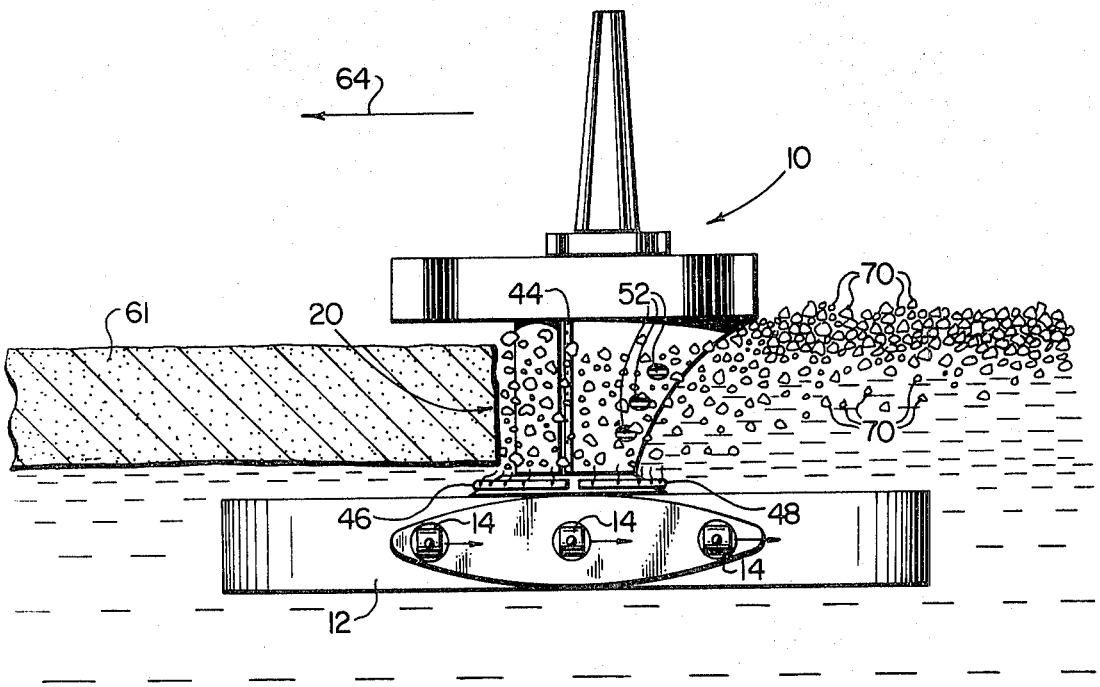
FIG. 4 is a side elevational view showing the effect of compressed air on ice chunks in accord with the invention.

Consider now FIG. 4 which illustrates the effect of compressed air (from any suitable compressor means, not shown) released from apertures 58, 60 the conduits 46, 48. As the thick ice field 61 is encountered by the operations vessel 10 traveling in the direction indicated by the arrow 64 (or as the operations vessel is maintaining a stationary position while the ice field 61 moves in the opposite direction), the ice disaggregating apparatus encounters and breaks the ice into many relatively small pieces 70. Inasmuch as the chunks 70 have a somewhat lower density than water they, of course, tend to rise, but, it has been found that the natural rate of ascent is sometimes too fast and can result in vertical packing to such an extent that ice disaggregation is interrupted if attempted beyond a relatively low and inadequate rate. However, when compressed air is controllably released from the conduits 46, 48, the effect is to decrease the buoyancy of the water/air mixture below that of the water alone by decreasing the mixture density, thus lowering the differential density between the ice chunks and the environment through which they are ascending. As a result, vertical packing is inhibited, and the ice chunks exhibit a greater tendency to spread beneath the ice outboard from the cut channel and also pile up somewhat above the surface of the surrounding ice, both important effects to achieving sufficient discharge volume to contain the disaggregated ice. It is useful to employ a plurality of air release subsystems as exemplified by the separate conduits 46 and 48 in order to provide separate control of the ice chunks ascent rate in different areas proximate the intermediate hull.

It may therefore be seen that the present invention effectively achieves a significant improvement in handling the vast quantities of discharged ice encountered in operation vessels adapted to engage and disaggregate very large quantities of ice which increase in volume upon disaggregation.

While the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

What is claimed is:

1. A semi-submersible operations vessel adapted for use in ice covered waters, said vessel including a subsurface flotation hull, an above-water deck structure, and an intermediate hull up-standing between said flotation hull and said deck structure, said intermediate hull including cooperating ice engaging, disaggregation, and clearing means comprising:

(A) a counter-rotating pair of vertically oriented, ice disaggregating drums;

(B) a nautrical wedge portion having a roughly triangular cross-section with a first side thereof being disposed proximate peripheries of said drums;

(C) pressurized hydro-jet means adapted to deflect disaggregated ice chunks, which ice chunks tend to follow natural flow paths proximate said drum peripheries, from said natural flow paths into preferred discharge paths, said pressurized hydrojet means comprising first and second vertical arrays of nozzles generally centrally disposed on said first wedge side and further disposed generally equidistant from the axes of said drum pair, said first and second nozzle arrays being directed, respectively, outwardly between said first wedge side and the periphery of a first drum of said drum pair and outwardly between said first wedge side and the periphery of a second drum of said drum pair, such that disaggregated ice tends to follow discharge paths proximate second and third sides of said nautical wedge, thereby preventing horizontal packup of disaggregated ice chunks in the region of said drums; and (D) air release means disposed proximate the lower end of said intermediate hull for controllably mixing air with seawater to provide a support fluid, for ice chunks disaggregated by said drum pair, which has a lower density than seawater alone, thereby controllably slowing the ascent rate of such ice chunks to inhibit vertical packup thereof.

2. A semi-submersible operations vessel adapted for use in ice covered waters, said vessel including a subsurface flotation hull, an above-water deck structure, and an intermediate hull up-standing between said flotation hull and said deck structure, said intermediate hull including cooperating ice engaging, disaggregation, and clearing means comprising:

(A) a counter-rotating pair of vertically oriented, ice disaggregating drums;

(B) a nautical wedge portion having a roughly triangular cross-section with a first side thereof being disposed proximate peripheries of said drums;

(C) pressurized hydro-jet means adapted to deflect disaggregated ice chunks, which ice chunks tend to follow natural flow paths proximate said drum peripheries, from said natural flow paths into preferred discharge paths, said pressurized hydrojet means comprising first and second vertical arrays of nozzles generally centrally disposed on said first wedge side and further disposed generally equidistant from the axes of said drum pair, said first and second nozzle arrays being directed, respectively, outwardly between said first wedge side and the periphery of a first drum of said drum pair and outwardly between said first wedge side and the periphery of a second drum of said drum pair, such that disaggregated ice tends to follow discharge paths proximate second and third sides of said nautical wedge, thereby preventing horizontal packup of disaggregated ice chunks in the region of said drums; and (D) at least two separately controllable air release means disposed proximate the lower end of said intermediate hull for controllably mixing air with seawater to provide a support fluid, for ice chunks disaggregated by said drum pair, which has a lower density than seawater alone, thereby controllably slowing the ascent rate of such ice chunks to inhibit vertical packup thereof, said first separately controllable air release means at least partially encompassing said counter-rotating ice disaggregating drums, and said second separately controllable air release means at least partially encompassing said nautical wedge.

3. The operations vessel of claim 2 which further includes secondary hydro-jet means disposed on second and third sides of said nautical wedge, said secondary hydro-jet means being directed generally perpendicularly to and away from said first side whereby ice chunks which have followed preferential paths proximate said second and third wedge sides are imparted with additional momentum away from said operations vessel.

* * * * *